United States Patent [19]

Ueno

[11] 3,958,900

[45] May 25, 1976

[54] CONVERTIBLE ENGINE-AIR COMPRESSOR APPARATUS MOUNTED ON A VEHICLE FOR DRIVING SAID VEHICLE

[76] Inventor: Takahiro Ueno, 5-11, 4-Bancho, Wakayama, Japan

[22] Filed: June 20, 1974

[21] Appl. No.: 481,183

Related U.S. Application Data

[63] Continuation-in-part of Ser. No. 369,119, June 11, 1973.

[30] Foreign Application Priority Data

| | | |
|---|---|---|
| June 22, 1973 | Japan | 48-70559 |
| July 2, 1973 | Japan | 48-74536 |
| July 5, 1973 | Japan | 48-76269 |

[52] U.S. Cl. ..... 417/237; 123/90.18; 123/198 F; 123/DIG. 7; 60/712

[51] Int. Cl.[2] ..... F04B 41/04; F04B 7/00

[58] Field of Search ..... 417/237; 123/90.18, 123/198 F, DIG. 7, DIG. 1; 60/712

[56] References Cited

UNITED STATES PATENTS

| | | | |
|---|---|---|---|
| 1,013,528 | 1/1912 | Broderick | 60/712 |
| 1,497,206 | 6/1924 | Booton | 123/90.18 |
| 1,556,410 | 10/1925 | Boyer | 123/90.18 |
| 2,676,752 | 4/1954 | Ochel et al. | 417/237 |
| 3,023,870 | 3/1962 | Udelman | 123/90.18 |
| 3,426,523 | 2/1969 | Straub | 417/237 |

*Primary Examiner*—Carlton R. Croyle
*Assistant Examiner*—Richard E. Gluck

[57] ABSTRACT

A combination engine and air compressor apparatus in which an engine action and an air compression action are changed over to each other by changing valve timing of inlet and exhaust valves.

2 Claims, 22 Drawing Figures

FIG. 1
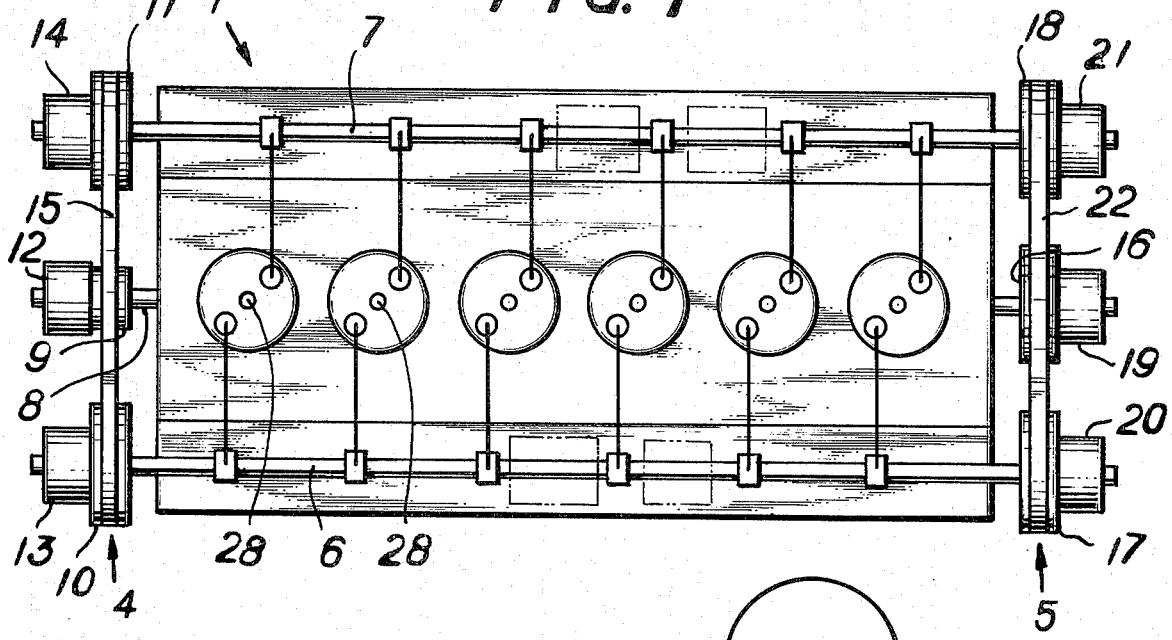
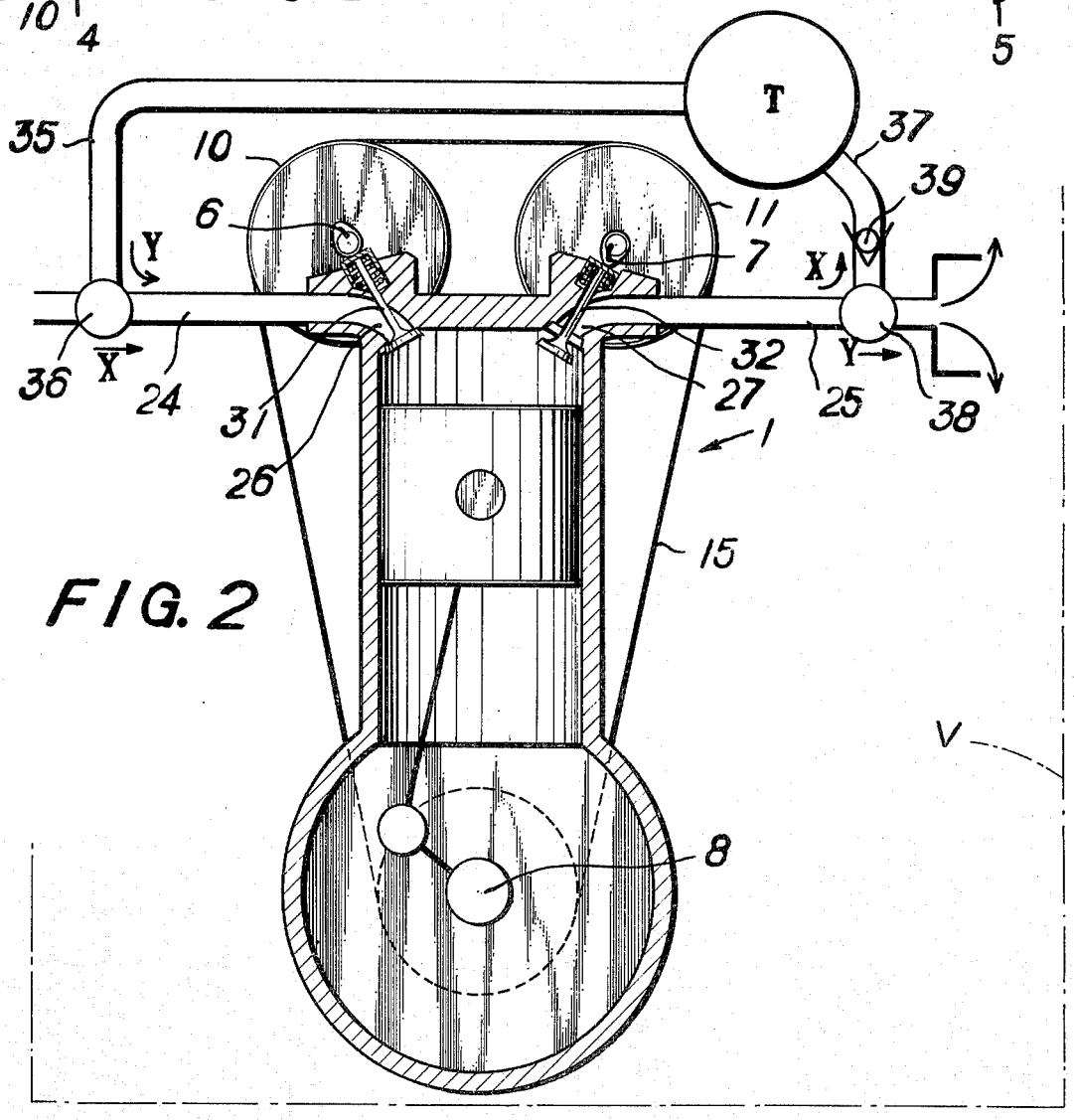
FIG. 2

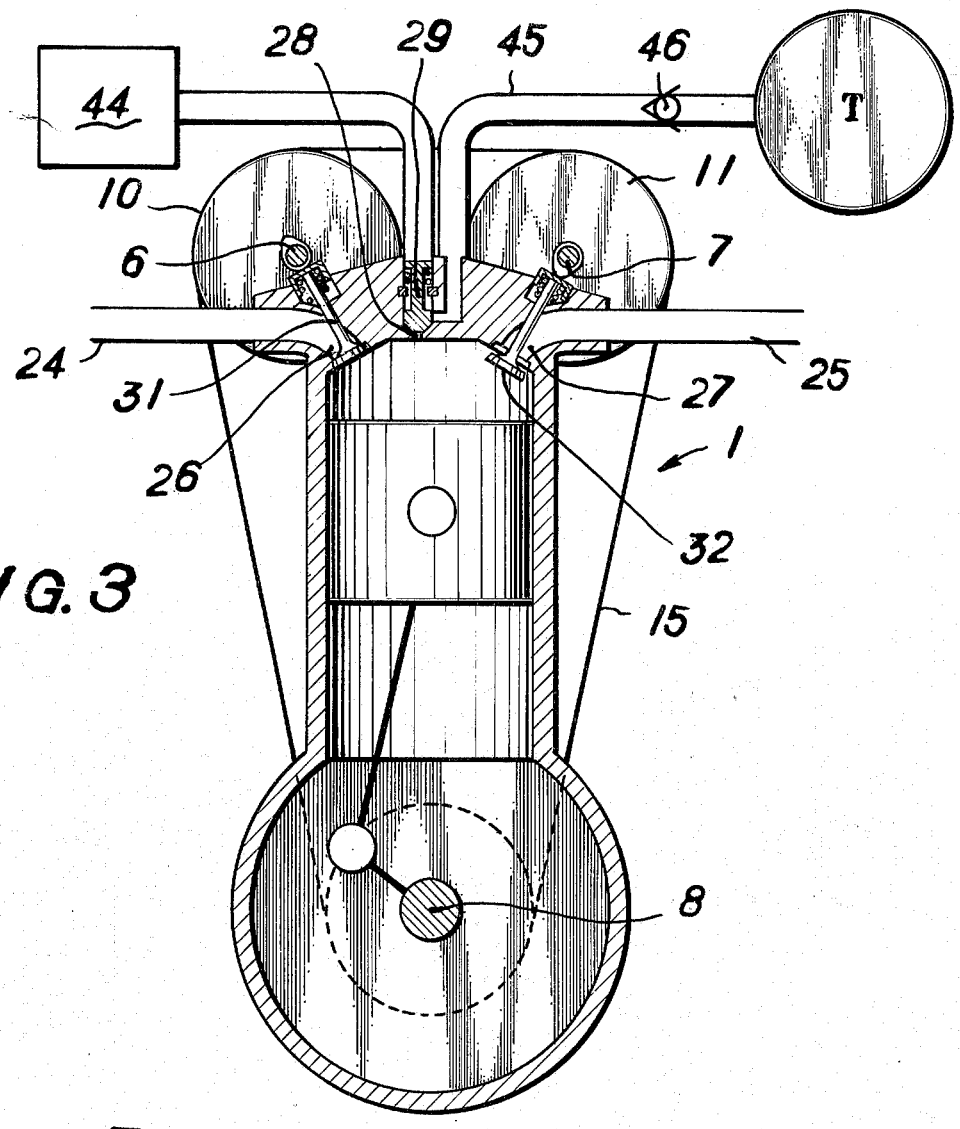
FIG. 3
FIG. 5
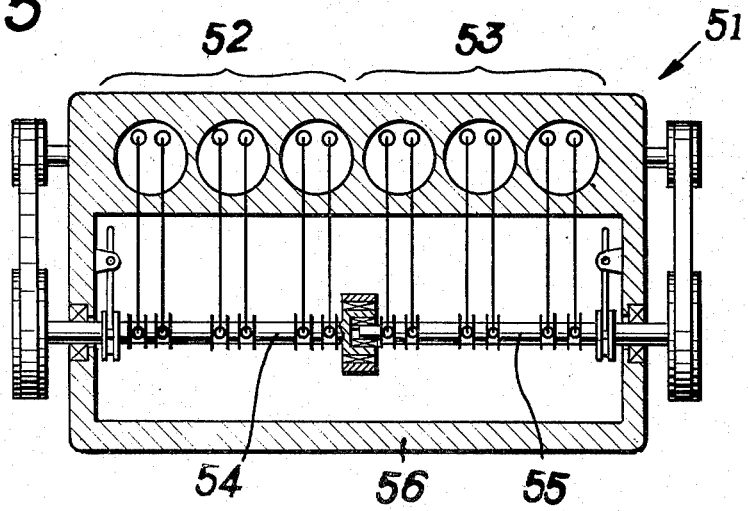

CONVERTIBLE ENGINE-AIR COMPRESSOR APPARATUS MOUNTED ON A VEHICLE FOR DRIVING SAID VEHICLE

RELATED APPLICATION

This application is a continuation-in-part of Ser. No. 369,119, filed June 11, 1973.

The present invention relates to an engine adapted to serve as an air compressor, especially to an internal combustion engine mounted on a vehicle.

The present invention further relates to an engine mounted on all the vehicles such as an automobile, a street car, a ship, an airplane and the like, which engine involves every internal combustion engine such as a gasoline-engine, a Diesel engine, a rotary engine and the like.

In this application, only a 4-cycle gasoline engine which is hard to be operated as an air cimpressor is described for easy understanding of the present invention.

The inventor has suggested that a plurality of cylinders of such an engine are divided into two sets to obtain separate operation of said each set of cylinders and actions of said sets are combined in such various manners as all the cylinders taking an engine action, one set of cylinders taking an engine action with the other taking an air compression action, all the cylinders taking an air compression action or the like, so that said single engine can be used for many applications. The inventor further suggested that such an engine is mounted on a vehicle so that travelling of the vehicle is improved, and that particularly in case of being used for an engine-brake, fuel expense is saved and environmental pollution is prevented.

The inventor has further suggested that compressed air obtained during a vehicle being braked can be used for starting an engine, operating an engine as an air-motor, or operating a vacuum suction device for braking a vehicle.

The present invention is a further improvement of such an engine, and mainly relates to an engine provided with double cam shafts and an engine supercharged with compressed air obtained at the time of braking or at a desired time. The present invention further discloses constructions for braking, stopping air-starting and rotating, and starting and continuing reverse rotation of such an engine in case of said engine is applied in a ship.

An engine according to the present invention is, even if it is a single cylinder engine, able to be operated as an air compressor or an air motor.

An engine according to the present invention is a known engine which comprises one or more cylinders, a piston adapted to slide in each of said cylinders, an inlet valve and an exhaust valve for opening and closing each of an inlet port and an exhaust port provided on the upper portion of said cylinder, two cam shafts each constituting a cam for operating said inlet valve or said exhaust valve, a transmitting means for transmitting rotation of a crank shaft to both of said cam shafts, an air supply means connected to said inlet port for supplying air and fuel thereto and a means connected to said exhaust port for guiding exhaust gas and others.

For taking an air compression action, the engine requires an air supply means for stopping fuel-supply to one or more chambers and supplying them with air only, an air take-out means for taking out at a desired time air compressed within said chambers, a tank for storing said compressed air, said tank being connected to an exhaust pipe constituting a part of said air take-out means, an operating means for operating at a desired time said air supply means and said air take-out means, and others. Said air supply means is a means for supplying said chambers with air only by stopping fuel-supply through a magnet valve into a carburetor or changing passages of an inlet pipe, and includes a means for giving a valve-timing to the inlet and the exhaust valves for an air compression action. Said operating means is a means for operating at a desired time magnet valves of the air supply means and the air take-out means and others. The air take-out means is a means adapted to change exhaust passage through a magnet valve thus to store compressed air.

An important object of the present invention is to provide an engine adapted to be made to take an air compression action by changing rotation angle of a cam shaft for an exhaust valve with respect to a crank shaft and by rotating cam shafts for an inlet and exhaust valves at the same rotational frequency with the crank shaft.

Another important object of the present invention is to provide an engine adapted to take an compression action or a no-load operation action by stopping fuel-supply to half a plurality of chambers and supplying them with air only, thereby saving fuel expense and preventing atomosphere pollution.

A further important object of the present invention is to provide an engine adapted to serve as an air compressor, which can suck air through an exhaust port by changing rotation angle of a cam shaft for an exhaust valve with respect to a crank shaft, and can exhaust air by means of an automatic valve provided on the cylinderhead.

A further object of the present invention is to provide an engine adapted to serve as an air compressor in which provided are two pairs of transmitting means for transmitting rotation of a crankshaft to each cam shaft one pair being for an engine action with the others being for an air compression action to cause an inlet and an exhaust valve to suck air.

A further important object of the present invention is to provide an engine adapted to serve as an air compressor in which by dividing a plurality of cylinders into two sets, the first set of cylinders is operated for an engine action while the second set for an compression action, and high pressure air obtained by said compression action set is reduced in pressure and used for supercharging the first set thereby increasing driving force of the engine and obtaining continuous operation without causing seisure.

A further object of the present invention is to provide an engine adapted to serve as an air-compressor in which by driving a compressed air machine or device by compressed air obtained in an air compression action segment, and by restoring the low pressure air after use and residual air in the air compression action segment in order to be used for supercharging an engine segment, thereby effectively using compressed air and preventing noise of the compressed air machine or device.

A further object of the present invention is to provide an engine adapted to serve as an air compressor, in which by injecting compressed air through a residual gas exhaust port the engine is rotated in the normal direction, and by changing valve-timings of inlet, exhaust and residual gas exhaust valves the engine is rotated in the reverse direction.

A further object of the present invention is to provide an engine adapted to serve as an air compressor, in which at the time of convertion from normal rotation into reverse rotation, the engine is braked by changing an engine action into an air compression action and absorbing kinetic energy for normal rotation belonging to the engine so that quickly responding reverse rotation is obtained without waste of kinetic energy.

A further object of the present invention is to provide an engine adapted to serve as an air compressor, in which by injecting high pressure air through an exhaust port of the engine the engine is actuated to rotate in the normal or reverse direction.

The features and advantages of the present invention will become more apparent from the following description of various kinds of embodiments thereof given with reference to the appended drawings.

FIG. 1 is a schematic plan view for illustration of the first and the second embodiments of the present invention;

FIG. 2 is a section of a cylinder of an engine of the first embodiment of the present invention;

FIG. 3 is a section of the second embodiment for illustration of a cylinder of an engine of the second embodiment;

FIG. 5 is a sectional plan view for illustration of the third embodiment of the present invention;

Figure 4:
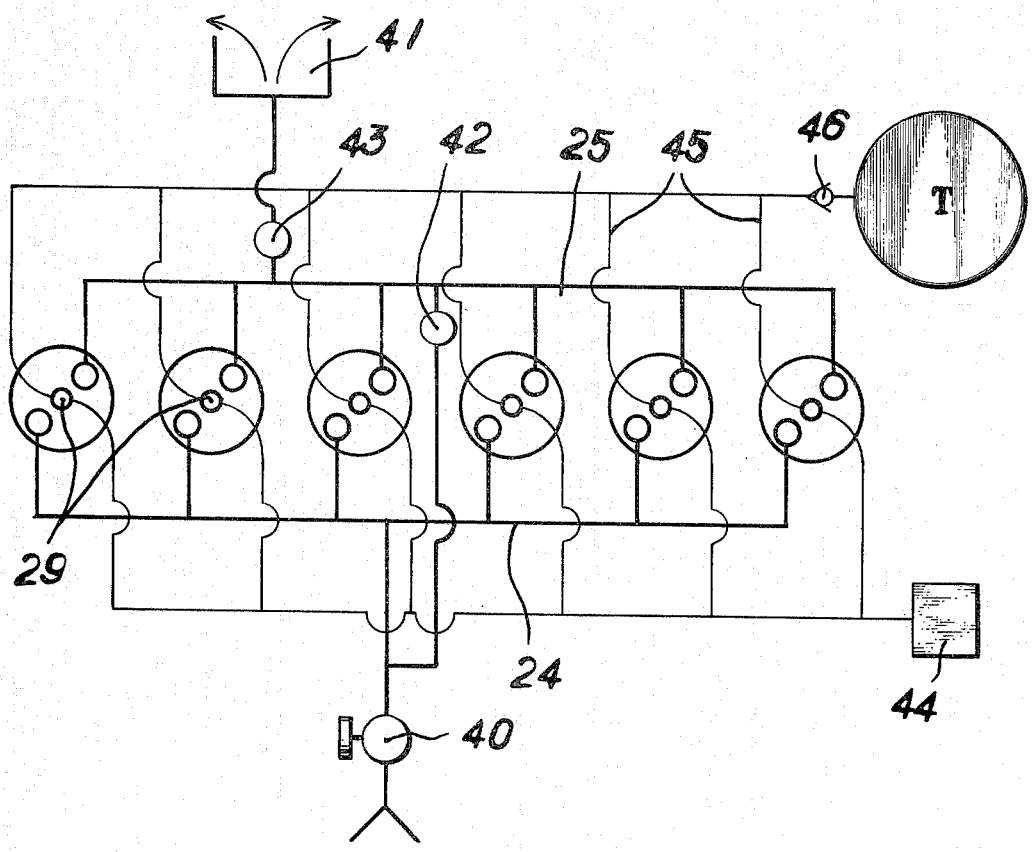
FIG. 4 is a schematic view of inlet and exhaust passages of the second embodiment.

Referring to FIGS. 1 – 4, the structure of an engine adapted to serve as an air compressor according to the present invention is shown by way of an engine provided with double overhead cam shafts as an example and mounted on vehicle V.

An engine 1 is provided with a known transmitting means 4 for transmitting rotation of a crank shaft to cam shafts for an engine action, and besides, another transmitting means 5 for transmitting rotation of the crank shaft to the cam shafts for an air compression action, further a means for changing over said two transmitting means and changing inlet and exhaust passages and others. Each of said transmitting means 4, 5 is adapted to operate a cam shaft 6 for an inlet valve or a cam shaft 7 for an exhaust valve respectively.

An engine provided with double overhead cam shafts is usually used for high speed travelling, in which engine, valve opening angle of the cam is very large e.g. 140° and overlapping angle is about 50°. Said transmitting means 5 is a means for eliminating such an overlapping and changing valve-timing at a desired time.

Said transmitting means 4 for an engine action comprises sprockets 9, 10, 11 each of which is rotatably fitted into a crank shaft 8, a cam shaft 6 or a cam shaft 7 respectively, electromagnetic clutches 12, 13, 14 for engaging said sprockets 9, 10, 11 with the corresponding shaft 8, 6, 7 at a predetermined position respectively and a chain 15 for simultaneously rotating said sprockets 9, 10, 11 in one direction. By passing electric current through said magnetic clutches 12, 13, 14, said cam shafts 6, 7 are operated, the rotation angle of said cam shafts with respect to said crank shaft 8 being the same with that of each cam shaft of the conventional engine. In other words, the transmitting means 4 for an engine action provides the cam shafts 6, 7 with valve-timing for an engine action.

Similarly to the transmitting means 4 for an engine action, the transmitting means 5 for an air compression action comprises sprockets 16, 17, 18, electromagnetic clutches 19, 20, 21 and a chain 22.

Two embodiments can be referred to here for achieving an air compression action of the engine 1. In the first embodiment, compressed air is taken out through an exhaust pipe 25 of the engine 1 as shown in FIG. 2, while in the second embodiment, an air port 28 is formed between an inlet port 26 and an exhaust port 27 and compressed air is taken-out through an automatic exhaust valve 29 provided in said air port 29.

Referring to FIG. 2, the first embodiment is now described below. The sprocket 16 of the transmitting means 5 has the same diameter with the sprockets 17, 18, and adapted to rotate each of the cam shafts 6, 7 with the same rotation frequency with that of the crank shaft 8. Thereby the inlet and exhaust valves are opened and closed once per a rotation of the crank shaft 8, so that the 4-cycle engine is given a valve-timing of a 2-cycle air compressor. Said valve timing is controlled by means of the electromagnetic clutches 20, 21. The electromagnetic clutch 20 is adapted to mount the sprocket 17 on the cam shaft 6, so that exhaust step is carried out at a timing a little delayed with respect to the corresponding timing in an engine action and after a piston is brought into a lowering action from the upper dead point.

On the other hand, the magnetic clutch 21 provided on the cam shaft 7 for the exhaust valve 32 is adapted to mount the sprocket 18 on the cam shaft 7, so that the exhaust valve 32 is closed when the piston reaches the upper dead point.

Further, the engine of the first embodiment may be so adapted that the difference between an engine action and an air compression action is made to consist only in their rotation frequencies, by providing only two electromagnetic clutches 12, 19 and fixing the sprockets 11, 13, 17, 18 on the cam shafts 6, 7, 12 respectively.

An inlet pipe 24, which is communicated with an inlet port 26, is connected to a pipe 35 which leads to an air tank T for storing compressed air obtained by a compression action of the engine, said air tank T being able to store therein 8–16 kg/cm² of air in case of making the engine serve as a 1-step air compressor, and 20–30kg/cm² of air in case of making the engine serve as a 2-step air compressor and in case of the engine being a Diesel engine.

Said pipe 35 is connected through a 3-way magnet valve 36 to said inlet pipe 24, and adapted to supply therethrough the inlet port 26 with mixed gas of fuel and air, air only or high pressure air. The 3-way magnet valve 36 is operated by an operating means.

A pipe 37 communicated with the air tank T is connected through a 3-way magnet valve to the exhaust pipe 25 communicated with the exhaust port 27.

A check valve 39 is provided on said pipe 37 so that high pressure air in the tank T is prevented from flowing to the exhaust port.

In case of the engine taking a compression action, by operating the operating means, the 3-way magnet valves 36, 38 are so opened that air flows in the X direction, and by demagnetizing the electromagnetic clutch 12 and magnetizing the electromagnetic clutch 19, the valve timing is converted into that of compression action.

Air having passed through a carburetor is supplied through the inlet port 26 into a chamber, and compressed therein and then supplied through the exhaust port 27 and 3-way magnet valve 38 into the air tank T to be stored therein.

Besides such an air compression action, the engine of the first embodiment of the present invention provided with the abovementioned structure can also be operated as an air motor for driving a crank shaft.

In case of the engine being operated to rotate in the normal direction as an air motor, 3-way magnet valves 36, 38 are opened so that air flows in the Y direction by operating the operating means and the inlet and exhaust valves are operated at the same timing with that of compression action.

When the flow takes Y direction through the 3-way magnet valves 36, compressed air (having pressure of 8–16 kg/cm² in case of a gasoline engine or 20–50 kg/cm² in case of a Diesel engine) in the air tank T flows to the inlet port 26, and is supplied into the chamber 2 by opening the inlet valve, then pushing down the piston. Energy of the high pressure air is consumed for operating the piston, and then discharged out through the exhaust pipe 25 by opening the exhaust valve 32.

On the other hand, in case of operating the engine to rotate in the reverse direction as an air motor, the 3-way magnet valves 36, 38 are opened in the X direction and compressed air is supplied through the pipe 37 and the exhaust port 27 into the chambers and then discharged out through the inlet pipe 24.

Referring now to FIG. 3, the second embodiment is now described below.

Similarly to the first embodiment, the magnet clutch 20 of the transmitting means 5 is adapted to mount the sprocket 17 on the cam shaft 6 so that the inlet valve 31 is opened when the piston is lowered from the upper dead point.

The sprocket 18 of the cam shaft 7 opens the exhaust valve when the piston is lowered from the upper dead point at the time in correspondence with the explosion step of an engine action, said sprocket 18 being engaged with the magnet clutch 21 at the position suitable for such valveopening.

The sprocket 16 has a diameter of half a diameter of the sprocket 17 or 18. In an air compression action, the inlet and exhaust valves are alternatively opened once per two rotations of the crank shaft 8 while the piston is being lowered. However, by making the gear ratio between the sprocket 16 and each of the sprocket 17, 18 1:1, thus rotating each cam shaft once per a rotation of the crank shaft, the inlet and exhaust valves are simultaneously opened at the times in correspondence with suction step and explosion step of an engine action, so that increased amount of air can be sucked.

In an air compression action, the exhaust valve is supplied with air only through an altered suction passage mentioned below and take a suction action.

The automatic exhaust valve 29 is provided on each cylinder head of the engine 1, adapted to be closed by means of an oil pressure, air pressure or electric means in an engine action and to automatically exhaust air compressed to a predetermined pressure in the cylinder in an air compression action, an exhaust port 28 of said automatic exhaust valve being connected through a duct to the air tank T. As said automatic exhaust valve, for example, an air charge valve can be applied.

Referring now to FIG. 4, operation and inlet and exhaust passages of the second embodiment are described below. During an engine action, in the engine 1, the transmitting means for an engine action is operated, a mixed gas sucked through a carburetor 40 and the inlet pipe 24 into each of the cylinders is combusted and then discharged through the exhaust pipe 25 and an exhaust gas port 41.

On changing-over an engine action to an air compression action, the magnetic clutches 12, 13, 14 are demagnetized and instead thereof the magnetic clutches 19, 20, 21 are magnetized to change rotation angle of the cam shafts for inlet and exhaust valves, thus opening a 2-way magnet valve 42, then closing a 2-way magnet valve 43 and a magnet valve (not shown) for closing a fuelling pipe in the carbureter 40 so that the inlet passage is changed and the pressure of a pressing means 44 having closed the automatic exhaust valve 29 by oil or air pressure is released. In such a state, air having passed through the carbureter 40 and the inlet and exhaust pipes 24, 25 is sucked through the inlet and exhaust ports into the cylinder till the predetermined pressure is obtained, and then exhausted through the automatic exhaust valve 29, a manifold and a check valve 46 into the air tank T then to be stored therein.

In the second embodiment, a magnetic clutch is provided at each position of a sprocket in order to decrease rotation noise and torque consumption of sprockets out of use during an action, but at least three sprockets are sufficient for such purpose and the positions of said sprockets may be variously changed. Further, by dividing both of the cam shafts into two in a proper proportion (for example, 3:3 in case of 6 cylinders), and providing a magnetic clutch (as shown in imaginary line in FIG. 1) at such divided position for free connection with each other, a part of the engine (the left three cylinders in FIG. 1) can be operated to take an engine action with the other parts (the right three cylinders in FIG. 1) operated to take an air compression action. In such a case, the inlet and exhaust passages are suitably changed.

The structures of the first and second embodiments can be applied to all the engines with double cam shafts of either a side valve type or an overhead valve type, and also to gasoline engines and Diesel engines.

Further, an engine provided with double overhead cam shafts is of a high speed travelling type and has small inertial mass, so that in case of the engine being operated as an air compressor inlet and exhaust valves are opened and closed two times in number the opening and closing operations in an engine action, but jumping, bouncing, surging or the like is prevented.

Referring now to FIGS. 5–12, the third embodiment of the present invention is shown for illustration of operation of an engine mounted on a vehicle for an air compression action.

An engine 51 is so adapted that only the right three cylinders are operated for an air compression action by supplying them with air only.

The engine 51 operates in five forms — all cylinders being operated for an engine action, the left three (the first set of) cylinders 52 being for an engine action with the right three (the second set of) cylinders 53 for an air compression action, said first set being operated as an engine to be supercharged with said second set as a supercharger for supercharging said first set, and the first set being operated as an engine with the second set in a no-load state.

A cam shaft 54 of said first set of cylinders 52 is adapted to be axially moved by a means for changing-over the position of the shaft by three steps while the second set 53 is axially moved by a two step change-over means. Further, the end portion of the cam shaft 54 adjacent to said cam shaft 55 is cylindrical and rotatably and slidably supported through a bearing by the engine body. On said cylindrical end portion of the cam shaft 54, the cam shaft 55 is rotatably and slidably supported.

Figure 6:
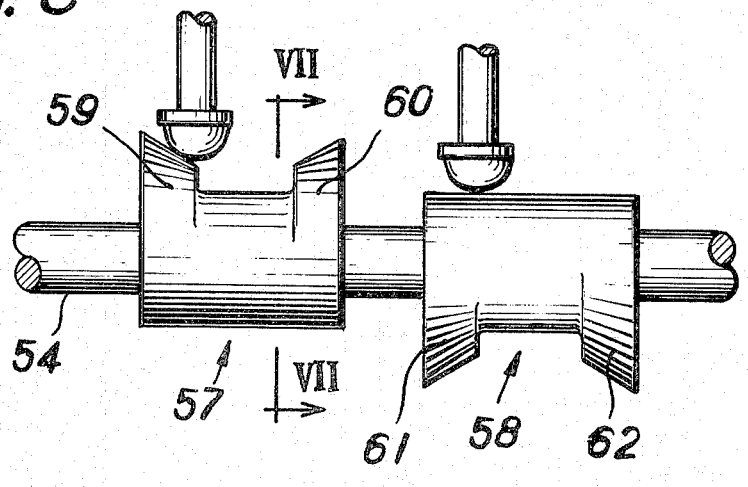
FIG. 6 is a front view for illustration of a cam for an inlet valve and a cam for an exhaust valve of the first set of cylinders of the third embodiment.
Figure 7:
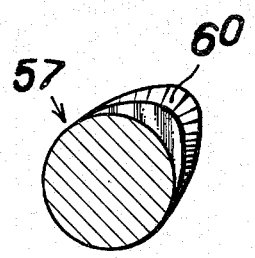
FIG. 7 is a section taken along line VII — VII of FIG. 6.

Referring to FIGS. 6, 7, shown are a cam 57 for an inlet valve and a cam 58 for an exhaust valve provided on the cam shaft 54 of the first set 52.

The cam 57 for the inlet valve is provided with a normal cam section 59 for normal overlapping and a supercharging cam section 60 with increased overlapping. In other words, said supercharging cam section 60 is provided for the purpose of making an overlapping angle relatively large so as to open the inlet valve before the exhaust valve being closed, blowing away residual gas in the clearance volume at the end of exhaust step with newly introduced air to replace the former by the latter for increasing sucked air in amount, increasing the mean effective pressure and thus increasing power.

The cam 58 for the exhaust valve is also provided with a normal cam section 61 and a supercharging section 62. Said four cam sections 59, 60, 61 62 have a different valve-timing respectively, but all substantially in the same form as the supercharging cam section 60 shown in FIG. 7.

Figure 8:
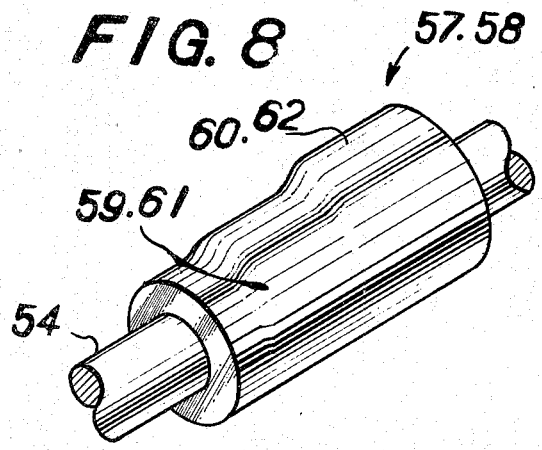
FIG. 8 is a perspective view for illustration of modifications of cams for inlet and exhaust valves of the first set of the cylinders of the third embodiment.
Figure 9:
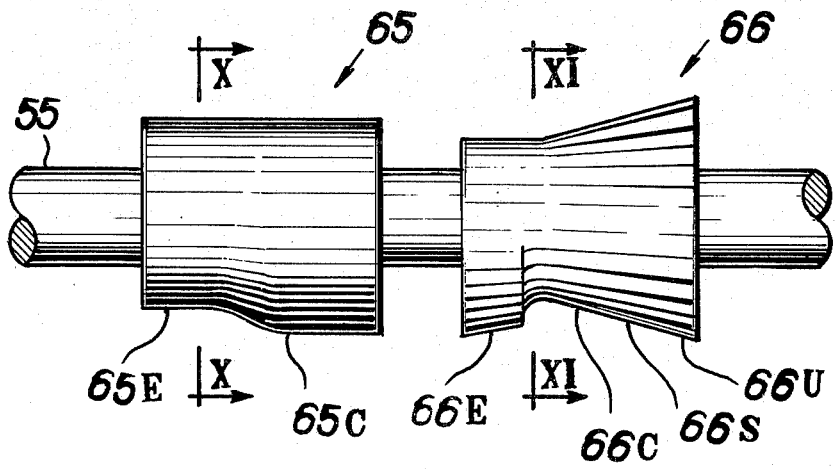
FIG. 9 is a front view for illustration of cams for inlet and exhaust valves of the second set of the third embodiment.

Referring to FIG. 8, shown is a modification of the cam 57 for the inlet valve or the cam 58 for the outlet valve, in which a normal cam section is adjacent to an supercharging cam section.

Referring to FIGS. 9–16, shown are a cam 65 for the inlet valve and a cam 66 for the exhaust valve provided on the cam shaft 55 for said first set of cylinders.

Figure 10:
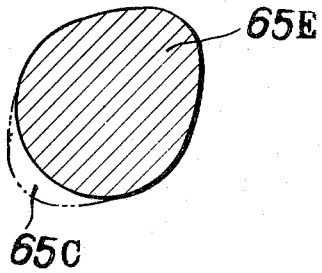
FIG. 10 is a section taken along line X — X of FIG. 9.
Figure 11:
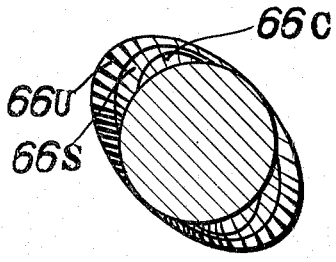
FIG. 11 is a section taken along line XI — XI of FIG. 9.

The cam 65 for the inlet valve comprises, as shown in FIG. 10, an engine action segment 65E (with the same sectional form of said normal cam section 59) which is adapted to open the inlet valve once per a rotation of the cam shaft, and an air compression action segment 65C adapted to open the inlet valve two times per a rotation of the cam shaft.

The cam 66 for the exhaust cam is provided with an engine action segment 66E, a 1-step compression action segment 66C, a 2-step compression action segment 66S and a no-load action segment, and only the engine action segment 66E operates the exhaust valve once a rotation of the cam shaft while the other operate the same twice a rotation of the cam shaft. The engine action segment 66E makes the same action with said normal cam section 61, and the 1-step air compression action segment 66C opens the exhaust valve a little before a compression and an exhaust steps of an engine action of the first set of cylinders end, to exhaust high pressure air. The 2-step compression action segment 66S opens the exhaust valve after a compression and exhaust actions of the engine start thus exhausting low pressure air. The no-load action segment 66U opens and closes the exhaust valve to blow air with overlapping the opening and closing operation of the inlet valve.

It is the most important feature of this embodiment that the action carried out by supplying the second set of cylinders with air is divided into three steps. The 1-step compression action segment 66C produces high pressure air (8–10 kg/cm$^2$ in case of a gasoline engine and 8–16 kg/cm$^2$ in case of a Diesel engine) used for operating a compressed air machine such as a cooler. The 2-step compression action segment 66S produces high pressure air similarly to the 1-step compression segment by compressing air by two steps, thus reducing the load of the first set 52 in starting the engine to smoothen the transition to an 1-step compression action. The no-load action segment 66U makes the vehicle travel only by an engine action of the first set 52 thus saving 50% of fuel expense.

Further, high pressure air produced by the second set of cylinders is supplied to the first set as supercharging amount through a pressure adjusting valve or after used in a compressed air machine, and then the power raising of the engine action of the first set is measured, so that a compression action of the first set is carried out with sufficient driving power.

The middle portion between the engine action segment 66E and the 1-step compression action segment 66C can keep the exhaust valve closed, and therefore can be used instead of the no-load action segment 66U.

Figure 12:
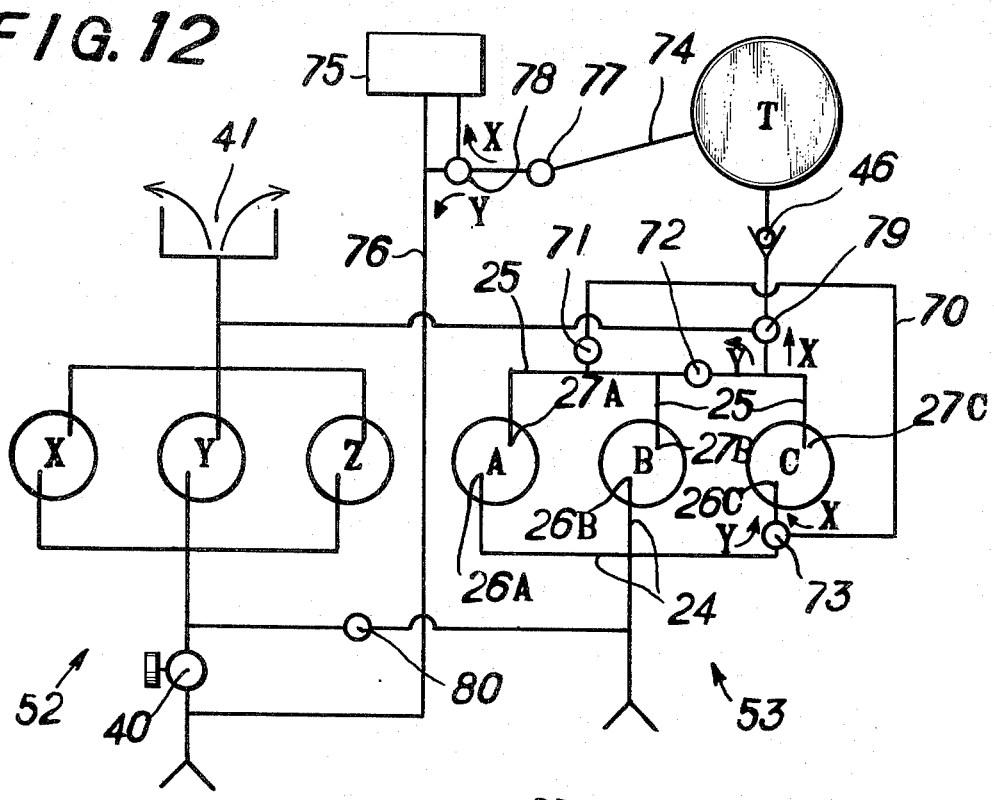
FIG. 12 is an explanatory view of inlet and exhaust passages of the engine of the third embodiment.
Figure 13:
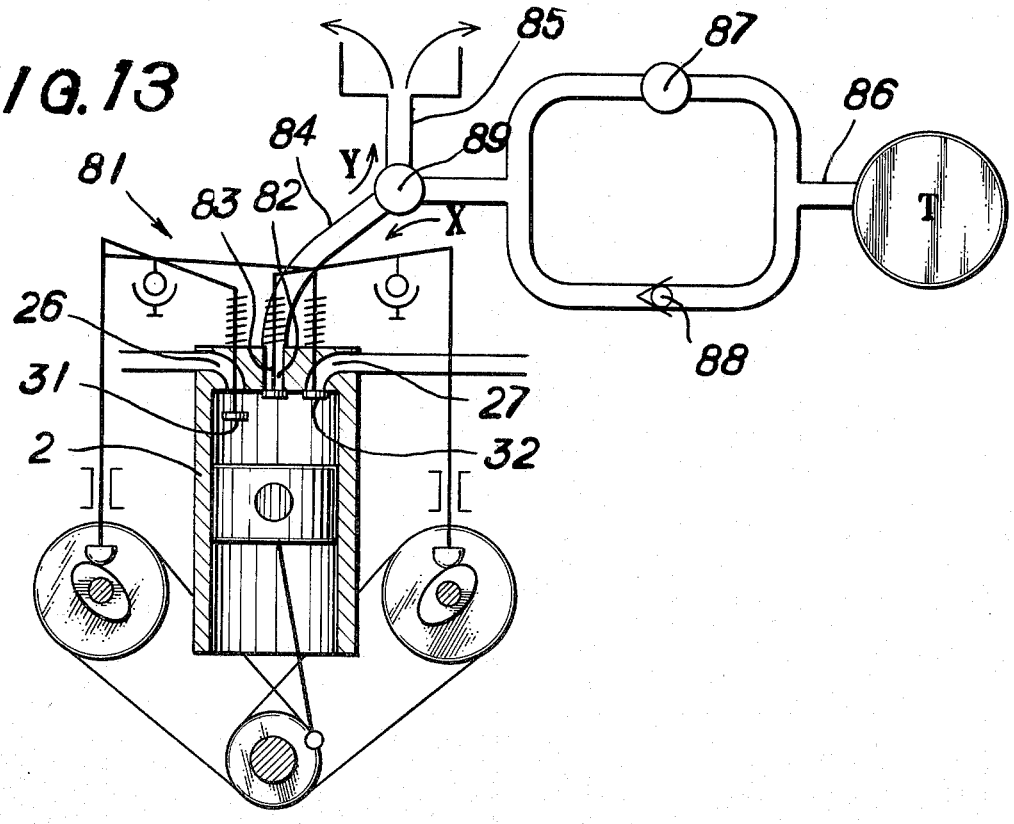
FIG. 13 is a section for illustration of a cylinder provided with an air port and an air port valve of the engine of the fourth embodiment of the present invention.

The operation of the engine 51 with the abovementioned construction and exhaust passages are described below with reference to FIG. 12.

In case of making the second set of cylinders take an air compression action with the vehicle stopping, the segments are so arranged that the inlet and outlet valves of the first set 52 is driven by the normal cam section, while the inlet valve of the second set 53 is driven by the compression action segment 65C and the outlet valve thereof is driven by the 2-step compression action segment 66S.

When chambers X, Y, Z of the first set 52 is actuated as an engine, a piston of the second set 53 connected to the same crank shaft operates, so that air is introduced through the inlet ports 26A, 26B and the inlet pipe 24 into the chambers, compressed therein substantially to 4 kg/cm², then exhausted through exhaust ports 27A, 27B and introduced through the exhaust pipe 25 and a duct 70 into a chamber C. The air introduced into the chamber C is compressed substantially to 8 kg/cm², then exhausted through an exhaust port 27C of the chamber C to be once stored in the air tank T. At that time, a 2-way magnet valve 71 is opened with a 2-way magnet valve 72 being opened and 3-way magnet valves 73, 79 being opened in the X direction.

When the turning force increases to bring the operation into a constant operation, the cam shaft 54 is displaced thereby operating the inlet and exhaust valves of the second set by means of the supercharging cam segment, and the cam shaft 55 is displaced thereby operating the exhaust valve of the second set 53 by means of the 1-step compression action segment 66C, and further the 2-way magnet valve 71 is closed, the 2-way magnet valve 72 is opened and the 3-way magnet valve 73 is opened in the Y direction.

In this state, air introduced into the chambers A, B, C is compressed at a time substantially to 8 kg/cm² and supplied into the air tank T. An air take-out pipe 74 is connected to the tank T, so that by opening the 3-way magnet valve 78 in the X direction, compressed air is supplied into a compressed-air machine 75 such as a cooler. From compressed-air machine 75 adapted to exhaust used air through one place, used low pressure air is lead through a restoration pipe 76 and introduced into the inlet pipe (ahead of the carbureter) of the first set 52 to be used for supercharging. Preferably, a rectifier is provided on said restoration pipe 76 for rectifying intermittently discharged air. Further, though not shown, the connected portion between the restoration pipe 76 and the inlet pipe is so adapted that back blow against the sucked air is prevented by opening the top port in the direction of sucked gas flowing through the inlet pipe.

Numeral 77 indicates the pressure adjusting valve. In case of using high pressure air in the tank T directly for supercharging by opening the 3-way magnet valve 78 in the Y direction, the pressure of said air is suitably lowered by means of said valve 77.

Said tank T can contain therein 8 kg/cm² of compressed air, and in case of air having pressure above 8 kg/cm², the pressure thereof is reduced for the purpose of its storage in the tank.

In case of making the vehicle travelling, the 2-way magnet valves 72, 80 are opened, the 2-way magnet valve 71 is closed and the 3-way magnet valves 73, 79 are opened in the Y direction. It is so arranged that the carbureter is fuelled and at the same time the inlet and exhaust valves of the first set are operated by the normal cam section while the inlet and exhaust valves of the second set are operated by the engine action segment.

Mixed gas is supplied from the carbureter 40 into all the cylinders and combusted in the chambers to become exhaust gas, and then exhausted through the exhaust port 41. In this case, the inlet pipe can be supercharged directly or through the compressed-air machine from the tank T.

When the vehicle is subject to idle rotation and cruising, it is not necessary for all the cylinders to take an engine action, but only the first set can take an engine action with the second set being in no-load operation. In such a case, the inlet and exhaust passages of the first and the second sets of the engine 51 are arranged for said air compression action, while the inlet valve of the second set is operated by the compression action segment 65C with the exhaust valve thereof operated by the no-load action segment 66U. Combustion action takes place in the chambers of the first set, but only air is blown into the chambers of the second set without either of combustion or compression action. However, such air blow takes place only in case of the 3-way magnet valve 79 being opened in the Y direction. If it is opened in the X direction no air is blown thereinto.

Further, at the time of reduction of the vehicle, the second set is made to take and air compression action using kinetic energy of the vehicle to produce compressed air substantially without consuming fuel.

In said embodiments all cylinders are adapted to take an engine action, but a part of cylinders may be adapted not to take an engine action but to take only an air compression action (including 2-step compression action) and an air motor action. Further, at the time of starting and acceleration of the vehicle, half a chambers is made to take an air motor action and the whole or a part of air used for said air motor action is used for supercharging in an engine action so as to make the vehicle travel, while during the vehicle travelling at a constant velocity half a cylinders are subject to unloading operation.

For the purpose of increasing durability of the engine, each cylinder is made to take an alternative action so that a chamber having taken an engine action is made to take a compression action with a chamber having taken a compression action made to take an engine action, every certain time, for example, every time after 40,000 km travelling of the vehicle.

Further, in a particular embodiment, by connecting a displacement compressor to an engine for travelling the vehicle, said engine is made to take only an engine action with said displacement compressor made to take an air compression action (including unloading operation) or an air motor action. In this case, the engine may have any number of cylinders, and the displacement compressor is selected to have a volume in correspondence with the power of said engine. As a displacement compressor, used can be an engine adapted for an air compressor.

Further, during travelling of a vehicle having thereon an engine with 4, 6, 8 or 12 cylinders, by making half of cylinders take an engine action to travel the vehicle, with making the remaining cylinders take an air compression action to store compressed air obtained therefrom in the tank, said tank is cooled using air blow caused by the travelling. And the compressed air at low temperature is made to expand in the tank through an expanding valve and utitized for cooling inside of the vehicle. The exhaust air from said cooler can be used for supercharging the engine action section. In case that the tank is filled with compressed air obtained by an compression action of the engine, the compression action section is subject to unloading operation, such a changing-over being easily effected by operating a valve for controlling an exhaust valve. Consequently, it is not necessary to always rotate the engine for operating the cooler, and to provide the cooler with an air compressor. As the result, fuel and resources can be saved. This system is effective when applied to engines, especially rotary engines which consume a large amount of fuel thus tending to cause environmental pollution. According to this system exhaust gas after being used in compressed air machines and apparatus is not dispersed in the atmosphere but introduced into the engine section, so that exhaust gas noise can be prevented by the masking effect.

Further, in case that after braking the vehicle (said braking is effected by a finger-brake system) by operating the second set of cylinders as a compressor brake or an ordinary exhaust brake the vehicle is immediately accelerated, the second set is supplied with compressed air so as to take an air motor action and then the first set is made to take an engine action. Even in this case, prevented can be bad feeling in travelling which is apt to be caused by fuel-cut in the vehicle with the conventional engine.

Usually, a supercharger is used for increasing the maximum power of an engine. However, a supercharger requires much expense, so that it is hardly used in a gasoline engine. On the contrary, according to the present invention, high pressure air obtained by an air compression action of an engine is reduced in pressure and cooled, and used for supercharging the engine section, thereby affording to lower necessary expense.

Such a mild supercharging is extremely effective and can contribute to prevention of atmosphere pollution tending to be caused at the time of increasing power of engine for starting or acceleration.

Further, in case of an engine with a supercharger, for example, a Diesel engine, the supercharger may be supplied with air at low temperature and low pressure, so that power is increased by a multiplied effect.

In case of an engine with double cam shafts as described in the first embodiment, each cam has a large overlapping in profile thereof and therefor is suitable for supercharging, so that a separate means is not required to be mounted thereon for supercharging, and that frequent gear-changings are not necessary at the time of increasing power.

FIG. 13 to 22 show the fourth embodiment of the present invention that is an engine wherein valve timing of the inlet and exhaust valves is changed so as to serve as an air-compressor and the third air port and valve are provided between the inlet and exhaust valves for exhausting the high pressure residual air during the engine effecting compressor action, and further high pressure air is charged through the third air port to rotate the engine per se normally or reversely. This embodiment is particularly useful for vessel engines.

Numeral 82 indicates a residual gas exhaust port to be used in case of making the engine take an air compression action, in which port provided is a valve 83 for opening and closing said residual gas exhaust port 82.

In a manifold 84 that is connected to said port 82, one branch 85 is connected to either free air or a supercharger, while the other branch 86 to a high pressure tank that contains a compressed air of approximately 20 to 50 kg/cm$^2$ (possibly 8 – 10 kg/cm$^2$). On the pipe 86 provided are an opening and closing valve 87 for supplying high pressure air fron the tank T to the exhaust port 82, and a check valve 88 for supplying high pressure air from the exhaust port 82 to the tank T. The compressed air in said tank has been obtained by the compressor action of the engine, which can be alternatively supplied from exterior. A three-way magnet valve 89 is provided at the branching point of the manifold 84, which switches the air flow between branches 85 and 86.

Figure 14:
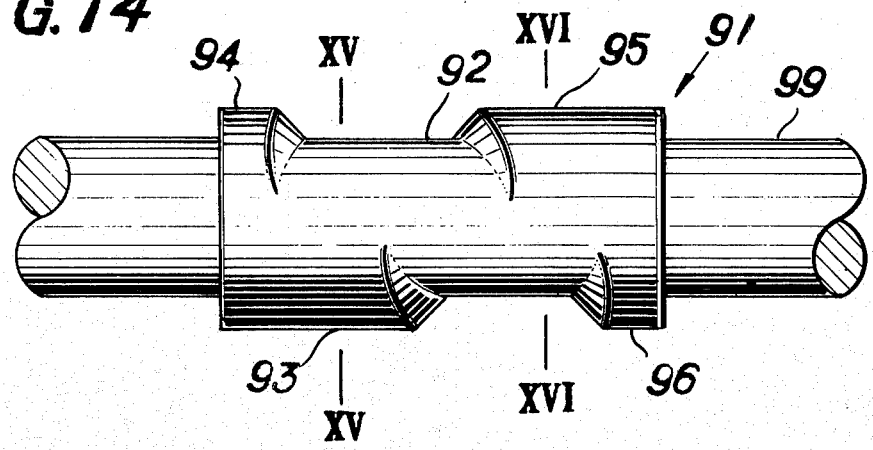
FIG. 14 is a schematic front view of a cam for operating a residual gas exhaust port.
Figure 15:
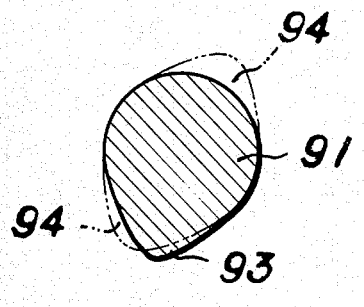
FIG. 15 is an end view taken along line XV — XV of FIG. 14.
Figure 16:
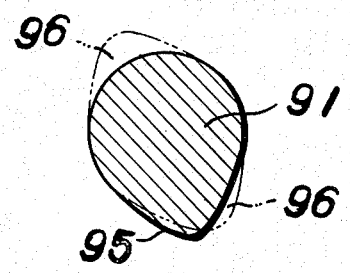
FIG. 16 is an end view taken along line XVI — XVI of FIG. 14.

FIGS. 14 to 16 respectively show a driving cam 91 for the valve 83, the cam comprising a cylindrical segment 92 for engine action which does not drive a tappet, a normal rotation starting segment 93 which drives at the time approximately corresponding to the starting of the explosion stroke in the engine action, a residual air exhaust segment 94 which drives for exhausting the residual air during the engine effecting normally rotating compressor action, a reverse rotation starting segment 95 which drives at the time approximately corresponding to the end of compression stroke during the engine effecting normal engine action, and a residual air exhaust segment 96 which opens during the engine effecting reversely rotating compressor action.

Said 3-way electromagnetic valve 89 opens to the direction of the arrow X to communciate the pipe 86 with the air port 82 only when the tappet of the valve 83 is in contact with the normal rotation starting segment 93 and the reverse rotating starting segment 95, while otherwise opens to the direction of the arrow Y.

Figure 17:
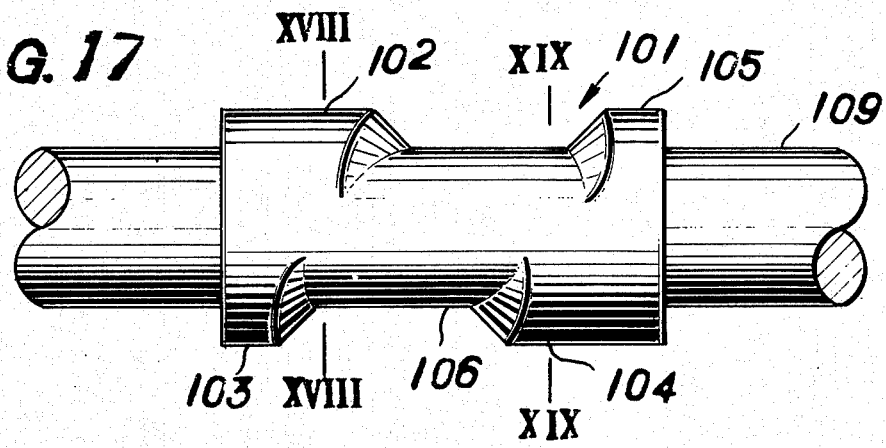
FIG. 17 is a schematic front view of a cam for operating an inlet valve.
Figure 18:
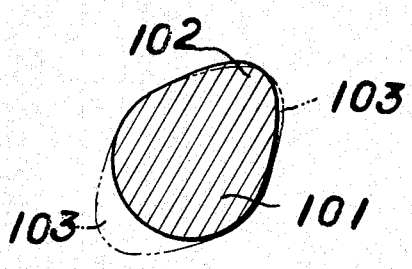
FIG. 18 is an end view taken along line XVIII — XVIII of FIG. 17.
Figure 19:
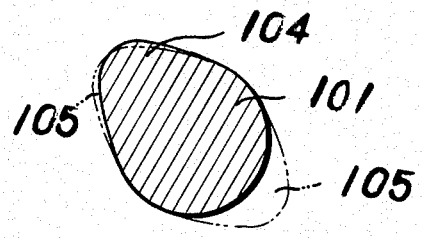
FIG. 19 is an end view taken along line XIX — XIX of FIG. 17.

The cam 101 for intake valve comprises, as shown in FIGS. 17 to 19, a normally rotating engine action segment 102, a normally rotating compressor action segment 103 which drives the tappet at the time approximately corresponding to air-intake and explosion strokes in the engine action, a reversely rotating engine action segment 104 which opens the valve in the exhaustion stroke in normal rotation of the engine, a reversely rotating compressor action segment 105 which drives the tappet at the time approximately corresponding to exhaustion and compression strokes in normal rotation of the engine (namely air-intake and explosion strokes in reverse rotation of the engine), and a cylindrical segment 106 connecting the segment 102 to the segment 104.

Figure 20:
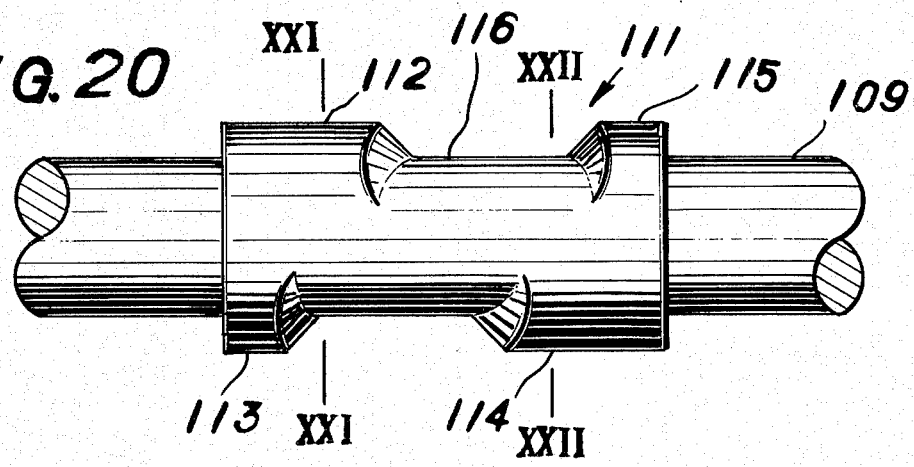
FIG. 20 is a schematic front view of a cam for operating an exhaust valve.
Figure 21:
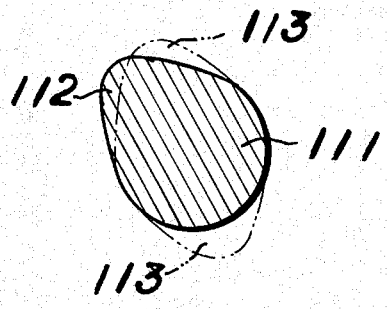
FIG. 21 is an end view taken along line XXI — XXI of FIG. 20.
Figure 22:
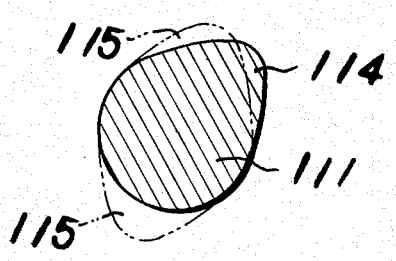
FIG. 22 is an end view taken along line XXII — XXII of FIG. 20.

The cam 111 for exhaust valve is represented in FIGS. 20 to 22 in the same shape as the cam 101 for inlet valve but is of course different therefrom in the time to start the tappet. The cam 111 comprises a normally rotating engine action segment 112, a normally rotating compressor action segment 112 which drives the tappet at the time approximately corresponding to exhaustion and compression strokes in engine action, a reversely rotating engine action segment 114 which drives the tappet at the time approximately corresponding to inlet strokes in normal rotation of the engine, a reversely rotating compressor action segment 115 which drives the tappet at the time approximately corresponding to air-intake and explosion strokes in normal rotation of the engine (namely exhaustion and compression strokes in reverse rotation of the engine), and a cylindrical segment 116 connecting the segment 112 and the segment 114.

In the cams 91, 101, 111 as shown in FIGS. 14, 17 and 20 the segments for reverse rotation and the segments for normal rotation are represented in the condition displaced by 180° with each other and each segments exist in the approximately symmetrical position with respect to the center line connecting the top dead centers as shown in FIGS. 15, 16, 18, 19 and 21. Further in the drawings, the first, second, third and fourth quadrants are corresponding, respectively, to the intake, exhaustion, explosion and compression strokes, and the imaginary lines represent compressor action segments.

The cam shaft 99 having the driving cam 91 for the valve 83 is provided seperately from the cam shaft 109 having the cam 101 for intake valve and the cam 111 for exhaust valve, each of the cam shafts being changed-over by sliding in five stages through hydraulic or electric means for changing-over the shafts.

Upon starting of normal rotation of the engine, the tappet of each of the valves is brought in cantact with the starting segment 93, and the normally rotating engine action segment 102, 112.

As soon as the cam is moved to bring the starting segment in contact with the tappet, high pressure air of about 20 – 50 kg/cm² (or 8 – 16 kg/cm²) flows into the air chamber through the air port 82 and the engine is started. Then by moving the cam 91 reversely to switch the tappet so as to be in contact with the cylindrical segment 92, the engine effects usual engine action.

In order to make the engine act as a normally rotating compressor the tappet is brought in contact with the residual air exhaust segment 94 and the compressor action segment 103, 113 thus the four cycle engine serving as a two cycle air-compressor, and residual air at the time is discharged from the air port 82 through the pipe 85.

In case of rotating the engine reversely, the normally rotating engine is changed once into normally rotating compressor action and braked, and after the engine stops the cam shaft 99, 109 is moved to bring the tappet in contact with the reverse rotation starting segment 95 and the reversely rotating engine action segment 104, 114.

Also in case of returning the reversely rotating engine to normally rotate, the engine is once made to serve as a reversely rotating compressor.

In the abovementioned fourth embodiment, in case of an engine with five or more cylinders, an air port valve 83 of any one of the cylinders is opened when the cam shaft 99 is moved and set so as to work the air port 83 by means of the normal rotation starting segment 93, so that the chamber can be supplied with high pressure air, thus easily affording to start the engine with air.

However, in case of an engine with four or less cylinders, and especially with a single cylinder, a piston sometimes stops at the top or bottom dead center, thus causing an air port valve to be closed.

Therefore, a decompression device (not shown) is provided for opening such a closed valve so as to make the engine to take an air motor action. In this case, the decompression device is not a device for pressure reduction but for pushing down a valve stem of the inlet valve to introduce air and for momentarily opening the air port valve of the engine set for an air motor action so as to compulsorily introducing high pressure air into a chamber thus rotating a crank shaft. In case that said crank shaft rotates in the positive direction, the air port valve can take a normal opening and closing operation thereby immediately working as an air motor. On the contrary, in case that said crank shaft rotates in the reverse direction, and air port valve is opened during the piston being raised and high pressure air injected through an inlet port causes the piston to be lowered, so that the rotation of the crank shaft turns into the positive direction. Also in case that the engine is set for reversely rotating operation, the engine if rotates undesirably in the normal direction will return to reverse rotation since valve timing of the air port valve is disturbed.

In case of an engine with two or four cylinders, a piston of any one of said cylinders stops at the top dead point even when the piston stops at a dead point, a crank shaft can be rotated a little. But in case of an engine with a single cylinder, a piston possibly stops at the lower dead point. Therefore, in case of an engine with a single cylinder, said engine is made to have such a construction that a little volume of low pressure air can be injected through an air exhaust port of a crank chamber. And there, a decompression device is operated after a piston is once displaced to the upper dead point.

The advantages of using an engine with the abovementioned construction in a ship are that a strong braking of the engine can be achieved in a very short time by an air compression action of the engine, that the compression action of the engine is influenced only by the compression ratio thereof and prevented to become destructive by a cushioning effect to air, and that in case of further increasing back pressure exerted in a piston, high pressure air compressed by two steps can be used for increasing back pressure for a compression action of each cylinder, thus affording making the engine rotation close to zero. In such a case, for example, the first set of cylinders are changed over into the state for reversely rotating engine action and at the same time other cylinders, for example, the second set of cylinders, are supplied with compressed air and operated as a reversely rotating air motor, and then brought into a high speed rotation at a stroke so as to take a reversely rotating engine action. And then, the second set of cylinders can be made to take a reversely rotating engine action similarly to the first set. Such a variety of applications of an engine, which have been impossible in the conventional engine, can be obtained according to the present invention.

After the engine is actuated and rotated by air, consumed compressed air has to be supplemented into the tank. For this purpose, compressed air can be obtained by operating the second set of cylinders as an air compressor. In this case, however, compressed air which is residual air in the second set has only to be used for supercharging the first set.

According to the present invention, compressed air can be obtained by a variety of combinations of actions of plural cylinders, so that a compressor provided on the conventional engine can be dispensed with.

In case that a compressor is required for double safety, attached to the main engine can be a normally and reversely rotatable combination engine and air compressor apparatus with a single or a plurality of cylinders as a starter, which has a suitable torque. Also for this purpose, a second-hand engine can be used after reconditioning in case of a low frequency of applications. In particular, the reconditioning expense can be lowered by utilizing a gasoline engine with double overhead cam shafts.

Further, also in such an engine with double cam shafts as described in said first embodiment, an engine action and an air compression action can be changed-over to each other by providing cams each for an engine action and for an air compression action on a cam shaft, and sliding said cam shaft similarly to the third embodiment. And with such an arrangement, even an engine with a small volume of cylinders can be easily operated as an air compressor, and at the same time the engine can be easily subject to an interlocking operation with the spring force adjusting means which has been already suggested by the inventor.

To sum up the advantages of the present invention:

1. The double cam shaft engine can serve as an air compressor easily by changing the rotation angle of the cam shaft for exhaust valve and rotating the two cam shafts in the same velocity with the crank shaft.

2. The engine can be worked as an air compressor simply and easily by providing a constant position electromagnetic clutch on the cam shaft of the engine and an automatic exhaust valve on the cylinder head.

3. During the vehicle's running, compressed air can be obtained by making a part or the whole of the engine serve as an air-compressor upon reduction of velocity.

4. During the vehicle stopping, compressed air can be obtained continuously by making a part of the engine serve as an air-compressor while making the other part serve as an engine.

5. Even an engine with four, six or eight cylinders or with an uneven number of cylinders can make a half of the cylinders serve as an air-compressor or do no-load operation during the vehicle's running, and thereby fuel consumption may be reduced and air pollusion may be prevented.

6. Since the plural cylinders are divided into two parts, one for an engine and the other for an air-compressor, so that the air-compressor part compresses the air in two stages into a predetermined pressure upon starting of the engine part, compressive load is so small that the engine part can be easily started.

7. Compressed air directly supplied from the tank and compressed air used in the compressed air machine are extremely low in temperature and are effective in utility as they are used for supercharging of the engine part, whereby even if the number of cylinders of the engine part is the same with that of the air-compressor part, driving power of the engine part is increased and the air-compressor part can be well started.

8. Since air exhausted from the compressed air machine is not discharged into the atmosphere but led into the engine part through a pipe, the compressed air machine is avoided from emitting noises.

9. By supplying the air chamber with high pressure air through the third air port newly provided, rapid starting of the engine with large torque can be effected, which increases effectiveness of the driver's operation.

10. Since upon conversion of rotating direction the engine is once braked, serving as an air-compressor, the rotating direction can be converted rapidly and kinetic energy of the engine can be used effectively.

11. Normal and reverse conversion of rotation of the engine can be effected easily and simply by providing a driving cam for reverse rotation on each of the inlet valve, the exhaust valve and the air port valve for exhausting residual air, and which mechanism is applicable to every engine, large-sized or small-sized.

12. Even as engine with four or less cylinders or a single cylinder can be started in normal or reverse rotation by providing decomp means.

What I claim is:

1. A convertible engine-air compressor apparatus adapted to be mounted on a vehicle for driving said vehicle comprising a body having a plurality of compression chambers in which explosion can take place, each of said compression chambers being provided with an inlet and an exhaust openings, an inlet valve and an exhaust valve mounted in the body for each compression chamber for opening and closing the inlet and exhaust openings, a piston reciprocably mounted within each compression chamber, crank shaft means rotatably mounted in the body and connected to the pistons for reciprocating the pistons, two cam shafts rotatably mounted on the body and connected to the crank shaft to be rotated thereby, a pair of cams for each inlet valve and each exhaust valve for each compression chamber mounted on a first cam shaft, each cam of each pair comprising a cylindrical segment, an engine action segment and an air compressor action segment, each of said segments adapted to engage tappet means, said tappet means reciprocably mounted on the body for each inlet and each exhaust valve for opening and closing the valves, said cylindrical segment adapted not to reciprocate the tappet means, said engine action segment adapted to reciprocate the tappet means once during each revolution of the associated cam shaft, said air compressor action segment adapted to reciprocate the tappet means twice during each revolution of the associated cam, an air port being provided between the inlet opening and the exhaust opening of each compression chamber, a valve being provided for each air port, a third cam for opening and closing said air port by means of a tappet means for said air port mounted on a second cam shaft for the air ports which is also mounted on the body and connected to said crank shaft to be rotated thereby, the third cam for said air port comprising a cylindrical segment, a rotation starting segment and a residual air exhaust segment, each segment of the third cam adapted to engage the tappet means for said air port, the tappet means for said air port reciprocably mounted on the body for opening and closing the air port valve and the cylindrical segment of said third cam adapted not to reciprocate the tappet means for said air port, said rotation starting segment adapted to reciprocate the tappet means for said air port once during each revolution of the second associated cam shaft, said residual air exhaust segment adapted to reciprocate the tappet means for said air port twice during each revolution of the second cam shaft, the first and the second cam shafts axially adjustable and mounted on the body so that the rotation starting segment of the third cam for said air port may engage the tappet means for the air port when the tappet means being in contact with the engine action segment of each cam of each pair, the cylindrical segment of the third cam for said air port may engage the tappet means for said air port, when the tappet means being in contact with the engine segment of each cam of each pair, the residual air exhaust segment of the third cam for said air port may engage the tappet means for said air port when the tappet means being in contact with the compressor action segment of each cam of each pair.

2. The apparatus of claim 1 wherein the engine action segment of each cam for each inlet valve and each exhaust valve comprises a normally rotating engine action segment and a reversely rotating engine action segment which are positioned in the condition connected to each other by said cylindrical segment, the air compressor action segment of each cam comprising a normally rotating compressor action segment connecting to the normally rotating engine action segment and a reversely rotating compressor action segment connecting to the reversely rotating engine action segment, each of said segments adapted to engage tappet means, said cylindrical segment adapted not to reciprocate the tappet means and said normally rotating engine action segment and said reversely rotating engine action segment adapted to reciprocate the tappet means once during each revolution of the first cam shaft, said normally rotating compressor action segment and said reversely rotating compressor action segment adapted to reciprocate the tappet means twice during each revolution of said cam shaft, the rotating starting segment of said cam for said air port comprising a normally rotating action segment and a reversely rotating action segment which are positioned in the condition connected to each other by said cylindrical segment, the residual air exhaust segment of the cam for the air port comprising a normally rotating residual air exhaust segment connecting to the normally rotating action segment and a reversely rotating residual air exhaust segment connecting to the reversely rotating action segment, each of said segments adapted to engage said tappet means for said air port, said cylindrical segment of said cam for said air port adapted not to reciprocate said tappet means for said air port, the normally rotating action segment and the reversely rotating action segment adapted to reciprocate said tappet means for said air port once during each revolution of the second cam shaft for said air port, said normally rotating residual air exhaust segment and said reversely rotating residual air exhaust segment adapted to reciprocate said tappet means for said air port twice during each revolution of the second cam shaft for said air port, and the first cam shaft and the second cam shaft for said air port axially adjustable and mounted on the body so that said tappet means for said air port may engage the normally rotating action segment of said cam for said air port when the tappet means being in contact with said normally rotating engine action segment of the cam, said tappet means for said air port may engage the cylindrical segment of said cam for said air port when the tappet means being in contact with said normally rotating engine action segment of the cam, said tappet mans for said air port may engage the normally rotating residual air exhaust segment of said cam for said air port when the tappet means being in contact with said normally rotating compressor action segment of the cam, said tappet means for said air port may engage the reversely rorating action segment of said cam for said air port when the tappet means being in contact with said reversely rotating engine action segment of the cam, said tappet means for said air port may engage the cylindrical segment of said cam for said air port when the tappet means being in contact with said reversely rotating engine action segment of the cam, and said tappet means for said air port may engage the reversely rotating residual air exhaust segment of said cam for said air port when the tappet means being in contact with said reversely rotating compressor action segment of the cam.

* * * * *